United States Patent [19]

Means

[11] 4,149,664

[45] Apr. 17, 1979

[54] STOP MEANS FOR USE IN A ROD GUIDING APPARATUS

[75] Inventor: Barry Means, Dyer, Ind.

[73] Assignee: United States Steel Corporation, Pittsburgh, Pa.

[21] Appl. No.: 850,767

[22] Filed: Nov. 11, 1977

[51] Int. Cl.[2] ..... B65H 17/22

[52] U.S. Cl. ..... 226/177; 226/187

[58] Field of Search ..... 226/176, 177, 181, 183, 226/187

[56] References Cited

U.S. PATENT DOCUMENTS

| | | | |
|---|---|---|---|
| 1,665,596 | 4/1928 | Lenston | 226/177 X |
| 3,147,901 | 9/1964 | Nordman | 226/176 |
| 3,227,344 | 1/1966 | Rutter | 226/176 X |
| 3,680,758 | 8/1972 | Kinnicutt | 226/183 |
| 3,777,964 | 12/1973 | Kruner | 226/183 |
| 3,786,742 | 1/1974 | Hertrich | 226/177 X |

*Primary Examiner*—Richard A. Schacher
*Attorney, Agent, or Firm*—Walter P. Wood

[57] ABSTRACT

A stop means embodied in a rod-guiding apparatus for limiting the gap between a spring-loaded roll and a pulley. The stop means can be adjusted by turning a screw-threaded adjuster to vary the maximum gap.

3 Claims, 2 Drawing Figures

"Prior Art"

STOP MEANS FOR USE IN A ROD GUIDING APPARATUS

This invention relates to an improved stop means embodied in a known apparatus used in a rod mill for guiding a rod as it travels around a bend.

Reference can be made to Kruner et al U.S. Pat. No. 3,777,964 for a showing of apparatus of the type in which the stop means of the invention is used, and the disclosure of the patent is incorporated by reference herein. The apparatus comprises a relatively large driven pulley and a plurality of smaller idler rolls (six shown) journaled in brackets which are pivoted to a roller box surrounding approximately one-quarter of the pulley circumference. The circumferential faces of the pulley and rolls have registering grooves which receive a rod and guide it as it travels around a bend, commonly as its direction of travel changes from horizontal to vertical. The brackets are spring loaded, whereby they are held in contact with a rod as it passes through the grooves, or in contact with the pulley when no rod is present.

A form of the apparatus more recent than that shown in the patent is known in which the roll mountings have adjustable stops to limit the gap or clearance between the rolls and pulley. The gap should not exceed 0.150 inch except at the grooves in order to make certain the rod stays in the grooves. The rolls and pulley vary somewhat in diameter. Hence it is necessary to adjust the stops each time the rolls or pulley are replaced. In the known mounting adjustments are effected only by inserting or removing shims. This is an unduly costly and time-consuming procedure which necessitates dismantling and reassembling the entire mounting. The usual time required has been about two and a half hours.

An object of the present invention is to provide, in an apparatus of the foregoing type, an improved stop means which enables adjustments to be made in the maximum gap quickly and easily without dismantling the mounting.

A further object is to provide an improved roll stop means which achieve the foregoing advantage and in which adjustments are effected simply by turning a screw-threaded adjuster.

In the drawing:

FIG. 1 is a vertical sectional view of a roll mounting equipped with stop means known in the prior art over which the present invention is an improvement; and FIG. 2 is a similar view, but showing the roll mounting equipped with stop means of the present invention.

THE PRIOR ART

FIG. 1 shows the edge portion of a relatively large diameter driven pulley 10 and one smaller idler roll 12 which are similar to corresponding parts shown in the aforementioned Kruner et al patent. The pulley is illustrated as having three circumferential rod-receiving grooves 13, 14, and 15 of different sizes to accommodate rods R of different diameters, and the roll a single groove 16 which can be brought into registry with any one of the three grooves in the pulley. Roll 12 is journaled on a shaft 17 on antifriction bearings 18. Shaft 17 is mounted in a bracket 19 pivoted within a roller box 20, likewise similar to the Kruner et al showing.

The roller box 20 carries a tubular housing 23 in which a plunger 24 is mounted in bearings 25 for axial movement approximately radial with respect to roll 12.

A tubular spring retainer 26 is threadedly engaged with the housing 23. A compression spring 27 encircles plunger 24 within the housing 23 and retainer 26. Spring 27 bears at its ends against the end wall of the retainer and a shoulder 28 on the plunger. The upper face of bracket 19 carries a pad 29 which has a rounded end abutting the lower end of plunger 24. Thus spring 27 acts through the plunger 24 and pad 29 to urge roll 12 toward pulley 10.

The upper face of bracket 19 also carries annular stop members 32 and 33 fixed thereto with machine screws 34. The annular member 32 can abut the lower end of the housing 23 and thus acts as a stop to limit the maximum gap between the roll and pulley. Shims 35 are inserted between the annular member 33 and the top of bracket 19 to adjust the maximum gap. As is apparent, shims 35 can be inserted or removed only when the entire mounting is dismantled.

DETAILED DESCRIPTION OF THE INVENTION

Figure 1:
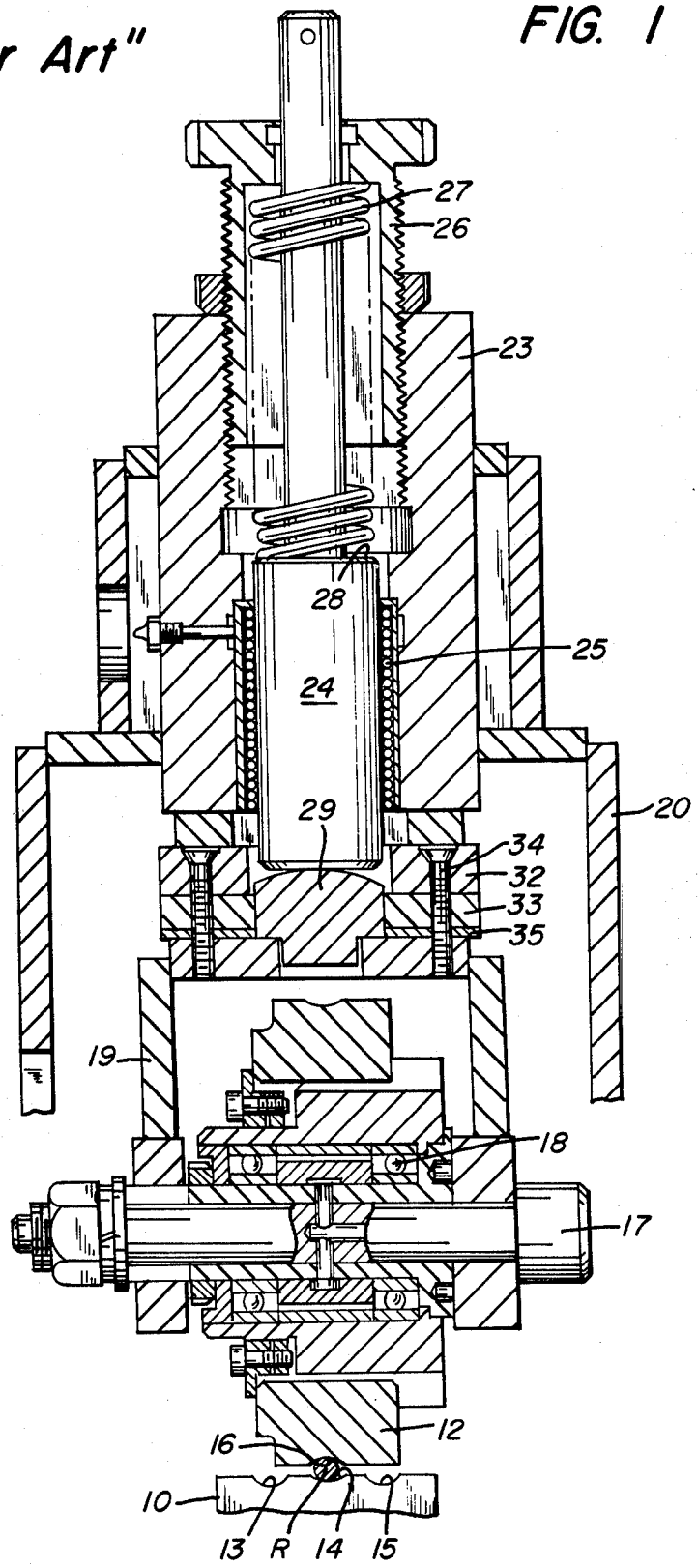
Figure 2:
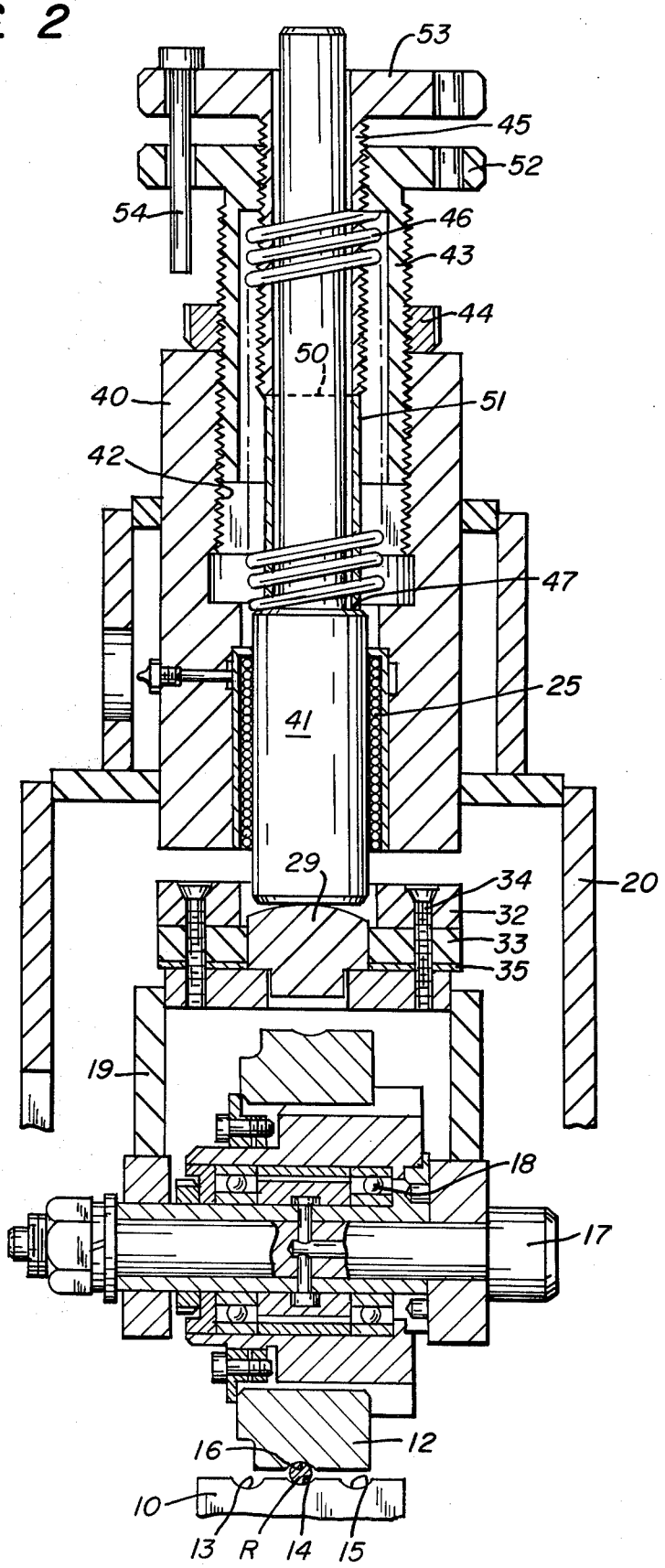

FIG. 2 shows a similar mounting equipped with stop means of the present invention. The pulley 10, roll 12, shaft 17, bearing 18, bracket 19, roller box 20, pad 29, annular members 32 and 33, and machine screw 34 are unchanged from the prior art shown in FIG. 1. Hence these parts are indicated by the same reference numerals, and the description is not repeated. Some or all shims 35 are omitted, and the annular members 32 and 33 no longer function as stops and could be omitted.

According to the invention, the roller box 20 carries a modified tubular housing 40 in which a plunger 41 is mounted for axial movement. The housing 40 has an internally threaded counterbore 42 in which an internally and externally threaded spring retainer 43 is received. A lock nut 44 is threadedly engaged with the spring retainer 43 and abuts the upper face of the housing 40 to hold the retainer in a fixed position. An externally threaded adjuster 45 is received within the spring retainer. A compression spring 46 encircles the adjuster 45 and plunger 41 within the housing 40 and spring retainer 43. The spring bears at its ends against the end wall of the retainer and a shoulder 47 on the plunger. The spring acts in a similar manner to spring 27 in urging the roll toward the pulley.

The plunger 41 has a second shoulder 50 conveniently formed by the end of a sleeve 51 which is placed over the plunger above the shoulder 47. The shoulder 50 can abut the lower end of the adjuster 45 and thus acts as a stop to limit the maximum gap between the roll and pulley. To adjust the maximum gap, it is necessary only to screw the adjuster 45 up or down. Preferably the spring retainer 43 and adjuster have wheels 52 and 53 to be engaged by a wrench to turn the retainer or adjuster. A pin 54 may be inserted through aligned holes in the two wheels to hold the adjuster in its adjusted position.

From the foregoing description, it is seen that the present invention affords a stop means which is easily adjusted simply by turning the screw threaded adjuster. Adjustments can be made in about fifteen minutes after new rolls or pulleys are installed, as there is no need to dismantle and reassemble the mounting. Although the stop means is described as used in a rod-guiding apparatus, the stop means may have broader application in apparatus for guiding flexible members other than rods.

I claim:

1. In an apparatus for guiding a flexible member as it travels around a pulley, which apparatus includes:

a relatively large pulley, at least one smaller idler roll engageable with said pulley, and means mounting said roll, said pulley and said roll having registering circumferential grooves for receiving and guiding a flexible member;

said mounting means comprising a roller box, a movable bracket within said roller box in which bracket said roll is journaled, a tubular housing carried by said roller box, a plunger within said housing, means on said bracket engaging said plunger, and spring means in said housing encircling said plunger and acting thereon to urge said roll toward said pulley;

the combination therewith of improved stop means limiting the maximum gap between said roll and said pulley, said stop means comprising:

a spring retainer mounted on the housing, against which retainer said spring means bears;

an adjuster threadedly engaged with said retainer and encircled by said spring means; and a shoulder on said plunger engageable with said adjuster;

said stop means being adjustable by turning said adjuster without dismantling said mounting means.

2. A stop means as defined in claim 1 comprising in addition a lock nut threadedly engaged with said retainer and abutting said housing to hold the retainer fixed relative to said housing.

3. A stop means as defined in claim 1 comprising in addition wheels fixed to said retainer and said adjuster and having holes, and a pin received in said holes for holding said adjuster in adjusted position.

* * * * *